US010925421B2

(12) United States Patent
Baratte

(10) Patent No.: US 10,925,421 B2
(45) Date of Patent: Feb. 23, 2021

(54) TASTING CUP

(71) Applicant: AB DESIGN CONCEPT & CREATION, Palleville (FR)

(72) Inventor: Arnaud Baratte, Palleville (FR)

(73) Assignee: AB DESIGN CONCEPT & CREATION, Palleville (FR)

( * ) Notice: Subject to any disclaimer, the term of this patent is extended or adjusted under 35 U.S.C. 154(b) by 69 days.

(21) Appl. No.: 15/763,046

(22) PCT Filed: Sep. 23, 2016

(86) PCT No.: PCT/FR2016/052417
§ 371 (c)(1),
(2) Date: Jul. 8, 2018

(87) PCT Pub. No.: WO2017/051134
PCT Pub. Date: Mar. 30, 2017

(65) Prior Publication Data

US 2019/0116998 A1 Apr. 25, 2019

(30) Foreign Application Priority Data

Sep. 24, 2015 (FR) ..... 1558993

(51) Int. Cl.
*A47G 19/22* (2006.01)
*B65D 23/04* (2006.01)
*B65D 3/28* (2006.01)

(52) U.S. Cl.
CPC ..... *A47G 19/2205* (2013.01); *B65D 3/28* (2013.01); *B65D 23/04* (2013.01); *A47G 2400/04* (2013.01)

(58) Field of Classification Search
CPC ..... A47G 2400/04; A47G 2400/045; A47G 19/2205; A47J 43/27; B65D 23/04; B65D 3/28
USPC ..... 215/DIG. 8
See application file for complete search history.

(56) References Cited

U.S. PATENT DOCUMENTS 3,495,736 A * 2/1970 Ragettli ..... A47J 47/18 220/670
2007/0125720 A1* 6/2007 Stecca ..... A47G 19/12 210/781
2007/0267422 A1* 11/2007 Barducci ..... A47G 19/2205 220/608

(Continued)

FOREIGN PATENT DOCUMENTS

CN 103519636 A 1/2014
EP 1 210 890 A1 6/2002

(Continued)

*Primary Examiner* — Fenn C Mathew
*Assistant Examiner* — Jennifer Castriotta
(74) *Attorney, Agent, or Firm* — Im IP Law; Chai Im; C. Andrew Im

(57) ABSTRACT

A beverage container includes a parison. Inside the parison, at least one relief is on the internal wall of the parison. The relief extends helically from a height on the parison lower than or level with the lip down to a level above or level with the bottom of the parison. The relief is configured to accept the beverage along one of its profiles and cause it to slide along its helix. The relief inclines so as to form a gutter with the internal surface of the parison over at least part of the length of the helix formed by the relief. The beverage container has an overall symmetry of revolution about a vertical axis Z.

8 Claims, 3 Drawing Sheets

(56) References Cited

U.S. PATENT DOCUMENTS

| | | | | |
|---|---|---|---|---|
| 2008/0290101 | A1* | 11/2008 | Stecca ..... | A47G 19/2205<br>220/703 |
| 2011/0303680 | A1 | 12/2011 | Baratte | |

FOREIGN PATENT DOCUMENTS

| | | | |
|---|---|---|---|
| WO | 2005/120306 | A1 | 12/2005 |
| WO | 2010/079225 | A2 | 7/2010 |

* cited by examiner

TASTING CUP

RELATED APPLICATIONS

This application is a § 371 application from PCT/FR2016/052417 filed Sep. 23, 2016, which claims priority from French Patent Application No. 15 58993 filed Sep. 24, 2015, each of which is herein incorporated by reference in its entirety.

FIELD OF INVENTION

This invention belongs to the fields of household equipment and tableware.

It concerns containers such as those for tasting certain drinks.

More especially, this invention concerns a container for tasting coffee or tea, for example.

BACKGROUND OF THE INVENTION

It is well-known that the same coffee, poured and drunk in cups that have different shapes, does not, with the same taster, have the same smell or the same taste.

This effect is due to several physical and chemical phenomena. Coffee, in its liquid form as served in cups is made up of multiple elements. More than 800 volatile aromatic compounds have been identified in roasted coffee of which 42 are phenolic in nature. These diverse molecules are more or less quickly freed into the air around the coffee according to the geometry of the cup. The free surface of the coffee in the cup determines the speed of release of the aromas and oxygenation of the coffee.

The desire to keep the aromas in a barely ventilated volume of air justifies the choice of a diameter of the upper part of the cup, known as the mouth, less than the maximum diameter of the container area of the cup, known as the parison.

Likewise, it is known that taste buds located in different areas of the taster's mouth are not dedicated to the perception of the same tastes: certain parts are particularly dedicated to the detection of bitterness, others to the perception of acidity, still others to the perception of the sweet or salty quality of a food, etc.

The form and diameter of the cup's mouth, channels the coffee being drunk towards certain taste buds in priority, which allows somehow to create a taste reading sequence that will highlight one or other of its qualities.

The choice of a quality container for a coffee or a tea that has required huge creative efforts may be decisive in the perception of its quality by the taster.

The internal form of the container thus becomes an object of research and of creation, in the search for the accentuation of the feeling of the olfactory and taste aromas which these drinks contain.

Containers specifically designed with the goal of putting a value on a particular type of coffee have already been suggested in prior art.

For example, the model "Reveal espresso, intense" from the NESPRESSO® brand, imagined and designed in partnership with the RIEDEL® company, has the form of a stemmed glass currently used for wine tasting. This glass allows the roasted notes of certain coffees to be concentrated and accentuated.

However, when the coffee or tea is served in containers known to man of the art today, the aromas of these drinks mainly remain under the foam which obliges the taster to manually agitate and remove the foam (for example, with the help of a spoon or a stirrer) to oxygenate the drink and obtain more flavors on the second bouquet.

The present invention aims to provide a container which allows the olfactory and taste aromas of a coffee or a tea or any other infusion, decoction, lixiviation or percolation to be revealed and accentuated, without any manual agitation of the container or of its content.

SUMMARY OF THE INVENTION

For this purpose, a first aspect of the present invention concerns a beverage container comprising a parison, globally with a rotational symmetry around a vertical axis Z, comprising on the inside of said parison at least one relief on the internal wall of the parison, said relief extending helically from a height of the parison lower than or equal to the level of the mouth, to a level higher than or equal to the bottom of the container, and being able to receive the beverage on one of its contours and make it slide along its helix, said relief being further inclined so as to form a gutter with the internal surface of the parison on at least one part of the length of the helix formed by said relief.

The term parison is used here as an analogy in the glass-making field although the parison according to this invention may be formed in a material other than glass. The parison can, for example, be made in glass with or without minerals, in crystal, in porcelain, in ceramic, or in an other material or mixture of materials, preferably without heavy metals.

Inclination here means that the relief is inclined according to an angle $\alpha$ towards the top of the internal surface of the parison in relation to a plane perpendicular to the vertical axis Z so as to form the gutter. Thus, the stop of the top of the relief is higher than the part of the relief the nearest to the internal surface of the parison. Indeed, the stop of the top of the relief forms the edge of the gutter and this stop of the top is higher than the bottom of the gutter formed by the inclination of the relief. In some embodiments, the relief is inclined according to an angle $\alpha$ comprised between 15° and 45° towards the top of the internal surface of the parison in relation to a plane perpendicular to the vertical axis Z. Preferably, the relief is inclined according to an angle $\alpha$ comprised between 15° and 30° towards the top of the internal surface of the parison in relation to a plane perpendicular to the vertical axis Z. Also, preferably, the relief is inclined according to an angle $\alpha$ of 20° towards the top of the internal surface of the parison in relation to a plane perpendicular to the vertical axis Z.

This relief inclination forming a gutter with the internal surface of the parison allows, in addition to the centrifugal force created by the helical movement followed by the beverage, that the majority of said poured beverage follows the helical path formed by the relief and thus minimizes overflow of the beverage above the stop of the top of the relief.

The presence of the relief helically extended on the internal wall of the parison and inclined to form a gutter with the internal surface of the parison on at least one part of the length of the helix formed by said relief, allows agitation of the beverage as it falls into the container, coming from a usual service device, for example, from a modern electrical coffee or tea maker. Indeed, when the beverage falls from the device according to its normal flow, it falls on to the relief on the inside of the container and thanks to the inclination of the relief towards the top of the internal surface of the parison, it is led against the internal wall of the parison (at the level of the bottom of the gutter formed by the relief) but is also led towards the bottom of the container by the slope of the relief because it makes a helical form extending from a height of the internal parison lower than or equal to the level of the mouth, to a level higher than or equal to the bottom of the container. Thus, the beverage slides along the helix formed by the relief, which allows the beverage to be oxygenated. The beverage arriving at the bottom of the container in a helical movement by means of the relief, is all the more stirred by a swirl created at the bottom of the container thanks to the speed resulting from the slope of the relief and thanks to the helical direction imposed on the course of the beverage by said relief. Such turbulence enables to obtain a second major oxygenation with accentuated organoleptic development without preventing the creation of foam or damaging the appearance of the latter if there is one, when the beverage is, for example, coffee or tea. The present invention, in addition to highlighting the second bouquet of the beverage at the time when one pours the beverage, does not prevent, especially when the beverage is coffee, to obtain a foam with a striped appearance, recognized as a gauge of quality of the coffee.

The relief on the internal wall of the parison starts at the height of the mouth of the container or lower and descends in a helical fashion along the wall to the bottom of the container or stops higher than the bottom.

In some embodiments, the parison comprises an egg-shaped bottom. The egg-shape allows the accentuation of the turbulence created at the bottom of the parison because when the beverage arrives at the end of the relief, at the bottom of the parison, it doesn't encounter any obstacle that would slow down the speed of its course in the bottom of the container. There is a continuity in the movement imposed on the beverage by the helical form of the relief and this imposed by the egg-shaped form of the bottom of the parison. The organoleptic development is thus accentuated by this continuity in the way followed by the beverage course thus allowing for the creation of better swirl at the bottom of the container and thus a better second oxygenation of the beverage.

In some embodiments, the relief extends helically according to a sloping angle comprised between 20° and 45° in relation to a plane perpendicular to the vertical axis Z.

The beverage will flow rapidly along the helical slope created by the relief, its speed being regulated by the degree of inclination of this slope.

In some embodiments, the relief extends helically according to a slope angle equal to 35° in relation to a plane perpendicular to the vertical axis Z.

In some embodiments, the relief is a shoulder of the internal surface of the parison.

Production of the relief as a shoulder of the internal surface of the parison is beneficial, when a person leans the container to empty the contents, to avoid the beverage, especially the last drops, following the helical relief in the opposite direction to that followed when it is served and thus only flowing from the container at the extremity of the relief, at its start (which may be, as indicated previously, at the level of the mouth of the container or lower). Flowing only at the extremity of the relief could be a problem if the taster does not place his mouth opposite to this extremity of the relief when he leans the container to drink its contents.

In some embodiments, the container comprises at the level of at least one of the two ends of the helix formed by the relief, an attenuation of this relief in the form of a wave until the relief disappears.

This attenuation of the relief in the form of a wave at the level of at least one of the two ends of the helix formed by the relief, allows, when a spoon or another stirrer is used to stir the beverage (for example, in order to dissolve sugar in the beverage), to not form a stop blocking the spoon or the stirrer when they are being used, for example, during circular movements along the internal surface of the parison.

In some embodiments, the container comprises at least one foot comprising at least one area of support with a surface.

In some embodiments, the container comprises at least one foot comprising at least three areas of support with a surface.

The presence of these three points of contact at the level of a foot improves the stability of the container when it rests on this foot.

In some embodiments, the container has a flared mouth.

The flared mouth allows, when a person lifts the container to his mouth and pours its contents into his mouth, that this content flows more onto the middle of the tongue, where the aromas are better captured compared to the back of the tongue where the vallat papillae are found, which are very sensitive to bitterness.

In some embodiments, the diameter of the mouth of the container is of a value comprised between 3.5 cm and 13 cm.

In some embodiments, the container comprises at least one handle.

DESCRIPTION OF THE FIGURES

The invention will be better understood on reading the following description, provided as a non-limiting example, and made by referring to the figures which show.

DETAILED DESCRIPTION OF THE INVENTION

At this time, we can see that the figures are not to scale.

Each characteristic of an embodiment may be implemented either in isolation or combined with any other characteristic of any other embodiment to its benefit.

We can note that the term "one" is used in the sense of "at least one".

Figure 1:
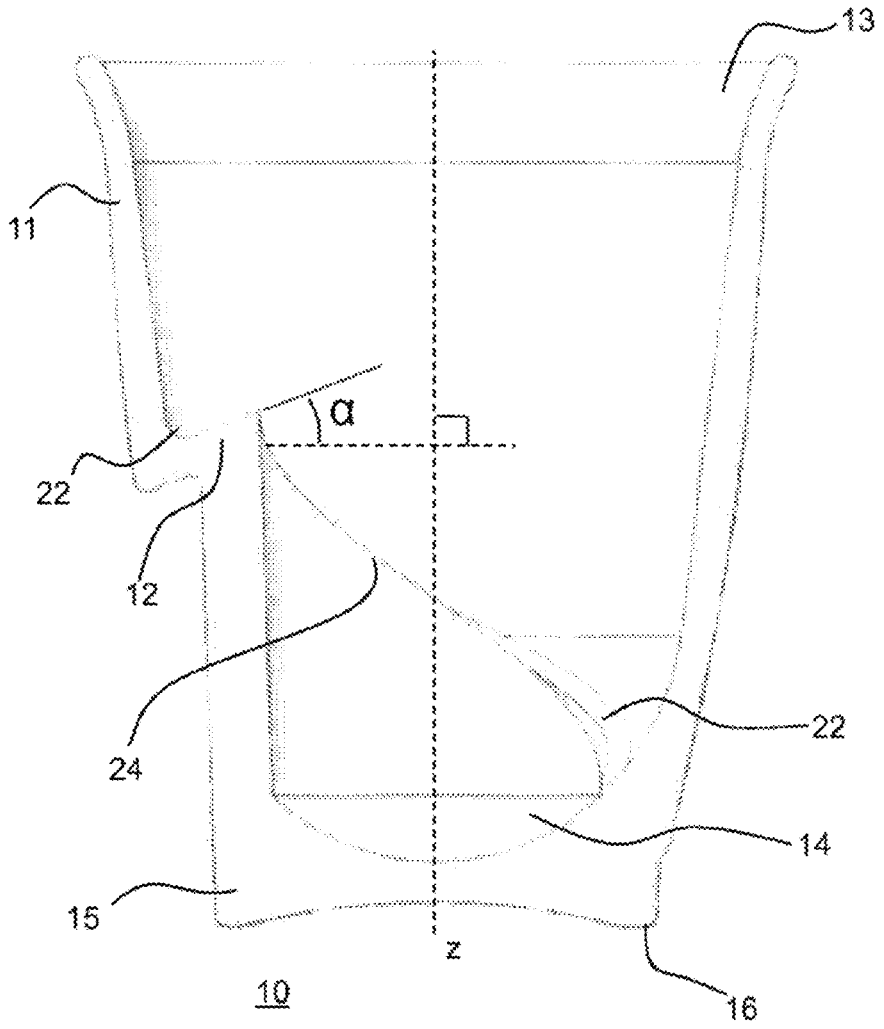
FIG. 1: a cross-section according to vertical axis Z, of the container according to one embodiment of the invention in which the relief, helically extended, is in the form of a shoulder.
Figure 2:
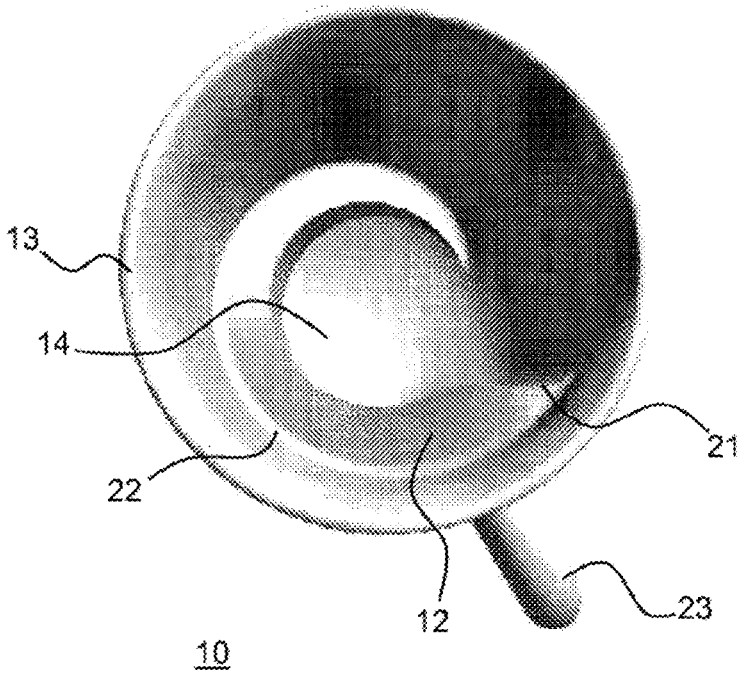
FIG. 2: a view from above of the container according to one embodiment of the present invention.

As we can see in FIGS. 1 and 2, the invention concerns a beverage container 10 comprising a parison 11 with, on the inside of the parison 11, at least one relief 12 on the internal wall of the parison 11, said relief 12 extending helically from a height of the parison 11 lower than or equal to the level of the mouth 13, to a level greater than or equal to the bottom 14 of the parison 11, and being able of receiving the beverage on one of its contours and making it slide along its helix. In the present case, the container 10 shows globally a rotational symmetry around a vertical axis Z.

In the description, we use the term mouth 13 to indicate the upper edge of the parison. In a preferred embodiment, as illustrated in FIG. 1, this mouth 13 is flared. This allows to orient the deposit of the contents of the container 10 into the mouth, in the middle of the tongue, where the aromas are best captured compared to the base of the tongue where the vallat papillae are located, which are very sensitive to bitterness. The diameter of the mouth 13 may be, for example, of a value comprised between 3.5 cm and 13.5 cm.

The parison 11 may be of different dimensions in order to contain different volumes. The thickness of the parison 11 depends on the manufacturing method of the present container 10. The invention remains, however, unchanged for a container 10 whose parison 11 is a cup or tumbler type or any other type of container or liquid container, with rotational symmetry.

The container 10 comprises a relief 12 extended helically on the internal wall of the parison 11. On FIG. 1, this relief 12 extends helically from a height of the parison 11 which is lower than the mouth 13 to a level which is slightly higher than the bottom 14 of the parison 11. In variants of embodiments of the container 10, the relief 12 may extend helically from a height of the parison 11 equal to the level of the mouth 13 and/or extends to a level equal to the bottom 14 of the parison 11.

The helical relief 12 is, as one can see on FIGS. 1 and 2, pressed against the internal sides of the container 10. The relief 12 profile is ideally that of a helical chute. In this embodiment, the relief 12 shows a width (by width of the relief 12, we mean the distance between the stop 24 of the top of the relief 12 and the internal surface of the parison 11), which gradually becomes smaller from top to bottom, from the start of the relief at the level lower than or equal to the level of the mouth 13, to the level greater than or equal to the bottom 14 of the parison 11. In the present embodiment, the width of the relief 12 is about 6 mm at the top part (at the level lower than or equal to the level of the mouth 13) and decreases until about 3 mm on the lower part (level greater than or equal to the bottom 14 of the parison 11). In some embodiments, the width of the relief 12 is comprised between 5 and 20 mm at the top part (at a level lower than or equal to the level of the mouth 13) and decreases to a value of between 1 and 10 mm at the lower part (level greater than or equal to the bottom 14 of the parison 11).

In specific embodiments such as that represented in FIG. 1, the relief 12 may be in the form of a shoulder of the internal surface of the parison 11, said shoulder extending helically as shown previously.

In the embodiment illustrated in FIG. 1, the relief 12 is inclined in order to form a gutter 22 with the internal surface of the parison 11 on at least one part of the length of the helix formed by the relief 12. In another specific embodiment the relief 12 is inclined in order to form a gutter 22 with the internal surface of the parison 11 along the all length of the helix formed by the relief 12.

By inclination, we mean that the relief is inclined according to an angle $\alpha$ towards the top of the internal surface of the parison in relation to a plane perpendicular to the vertical axis Z in order to form a gutter 22. The part of the relief 12 which is the nearest to the vertical rotational axis Z, that is to say, the stop 24 at the top of the relief 12, is much higher than the part of the relief 12 which is the nearest to the internal surface of the parison 11. In some embodiment examples, the relief 12 is inclined according to an angle $\alpha$ comprised between 15° and 45° towards the top of the internal surface of the parison in relation to a plane perpendicular to the vertical axis Z. Preferably, the relief 12 according to an angle $\alpha$ comprised between 15° and 45° towards the top of the internal surface of the parison 11 in relation to a plane perpendicular to the vertical axis Z. Still preferably, the relief 12 is inclined according to an angle $\alpha$ of 20° towards the top of the internal surface of the parison 11 in relation to a plane perpendicular to the vertical axis Z. This inclination allows to reduce or avoid the beverage overflowing above the stop 24 of the relief 12, during its pouring onto this relief 12, and during its descent along the helix formed by the relief 12.

When the container 10 is in its normal position to receive the beverage (the diameter of the mouth 13 being horizontal), for example placed on a table or on a base of a service device such as a modern electric coffee or tea maker, the presence of the relief 12 inclined in order to form a gutter 22 extended helically onto the internal wall of the parison 11 allows for significant agitation of the beverage from its pouring into the container 10. This beverage is usually served by a serving device such as a modern electric coffee or tea maker creating a stream of the beverage cooling from the service device to the interior of the container 10 during service, said stream falling onto the relief 12. Indeed, when the beverage stream of the device according to its usual flow, it falls onto said relief 12 inside the container 10 and is directed towards the internal surface of the parison 11 by the inclination of the relief 12 towards the top of the internal surface of the parison 11 but is also directed towards the bottom 14 of the container 10 by the slope of the relief 12. The relief 12 thus plays the role of gutter 22 preventing or limiting the fact that the beverage passes over the stop 24 of the top of the relief 12 when it is poured onto the relief 12 and forcing this beverage to follow the helical trajectory towards the bottom 14 of the container 10 by the slope of the helix that represents the relief 12 which allows the beverage to undergo a first oxygenation.

In the embodiment illustrated in FIGS. 1 and 2, the bottom 14 of the parison 11 is egg-shaped. The egg-shaped form accentuates the turbulence created at the bottom of the parison 11 because when the beverage reaches the end of the relief 12 it doesn't encounter any obstacles to slow down the speed of its course in the bottom 14 of the parison 11. This continuity in the helical movement followed by the beverage allows to accentuate the organoleptic development by generating a swirl at the bottom 14 of the parison 11 during a much longer period during service than with a flat-bottomed parison 11. Thus, a second oxygenation of the beverage is better obtained.

In some embodiments, as illustrated in FIG. 2, the container comprises at the level of at least one of the two ends of the helix formed by the relief 12, an attenuation 21 of said relief 12 that is to say a reduction of the width of the relief 12. This attenuation 21 is advantageously in the form of a wave until the disappearance of the relief 12.

This attenuation 21 of the relief 12, in the form of a wave, allows that when a spoon or another stirrer is used to stir the beverage (for example, with the aim of dissolving sugar in the beverage), it does not form a stop at the end of the relief 12 likely to block the spoon or stirrer while they are being used, for example, when making circular movements along the internal surface of the parison 11.

The relief 12 may extend helically according to a slope angle comprised between 20° and 45° in relation to a plane perpendicular to the vertical axis Z, preferably comprised between 25° and 40°, more preferably according to a slope angle of 35°.

In the embodiment illustrated in FIG. 1, the container 10 comprises at least one foot 15 comprising at least one area of support 16.

In some embodiments, the container 10 comprises at least one leg connected to the bottom 14 of the parison 11 and the foot 15 is located at the end of this leg opposite the end of the leg to which is connected the parison 11.

In some embodiments, the container 10 does not have a leg and the bottom 14 of the parison 11 is used as the foot 15 comprising at least one area of support 16. To do this, the container 10 has a parison 11 which is clearly thicker in the bottom part 14 of the parison 11.

The foot 15 of the container 10 presents the general form of a thick disk with classic dimensions with regards to height and volume of the container 10, with an axis coinciding with the rotational vertical axis Z of the container 10.

Figure 3:
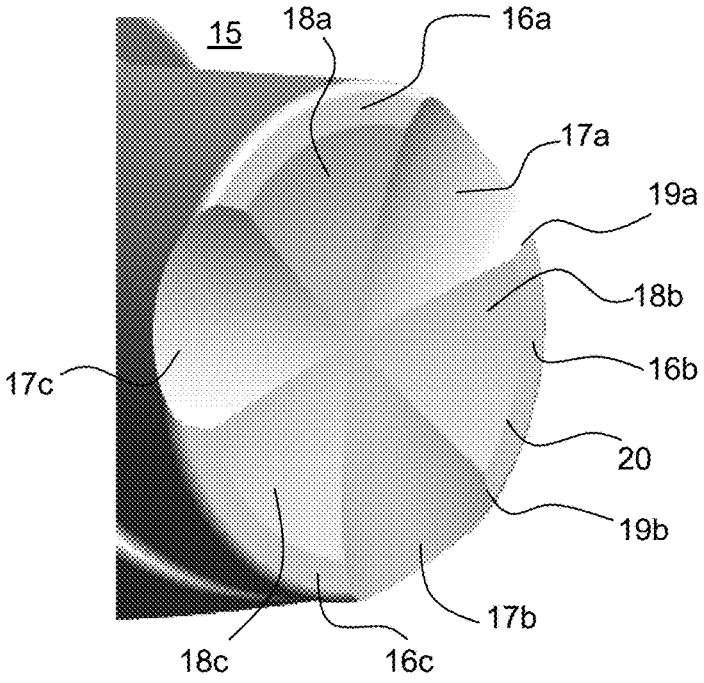
FIG. 3: a view from below the container, showing the areas of support of the foot of the container.
Figure 4:
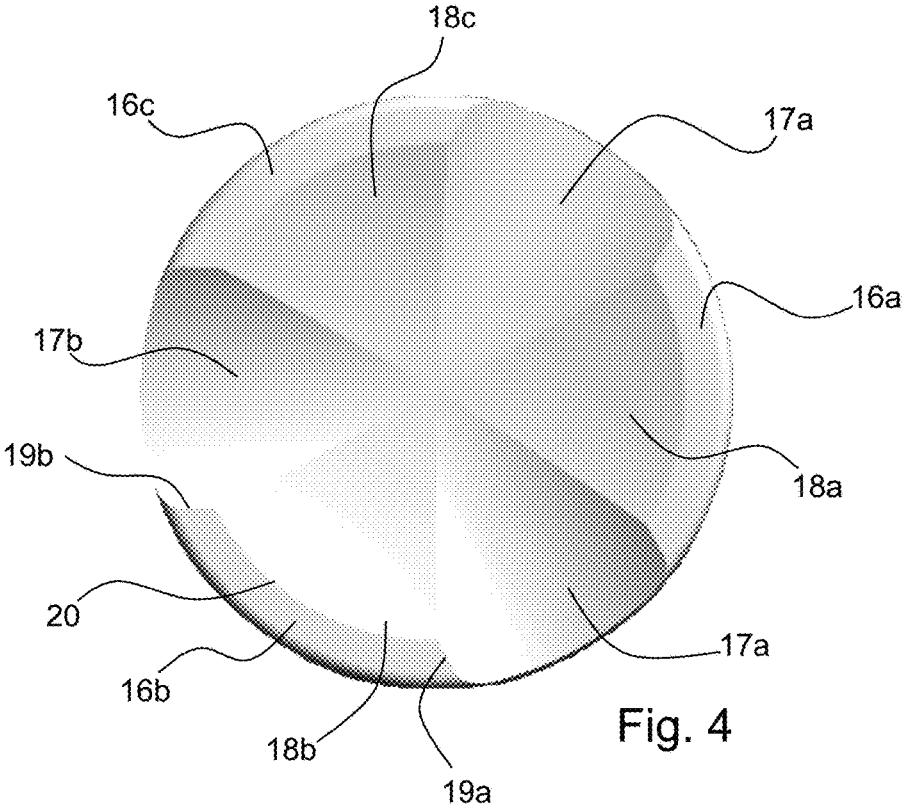
FIG. 4: a view in perspective of the foot of the container.

In some embodiments, as in the one illustrated by FIGS. 3 and 4, the foot 15 comprises, on the lower face (intended as a support on the surface of the container support 10), three areas of support 16*a*, 16*b*, 16*c*, sensibly flat and coplanar, located on the periphery of the foot, with a 120° angular deviation from each other. These three areas of support 16*a*, 16*b*, 16*c* form an isostatic support for the container 10. Their width is variable, and they protrude with regards to the rest of the lower face of the foot 15.

The lower form of the foot 15 (and those of the areas of support 16) is obtained by removal, in a flat disk comprising the three areas of support 16*a*, 16*b*, 16*c*, of three cylinder sectors 17*a*, 17*b*, 17*c*, of the same radius, with horizontal axes spaced angularly at 120° from each other, and incurring at a same point of the vertical axis Z of the container 10, situated under the plane formed by the areas of support 16*a*, 16*b*, 16*c*. These three cylinder sectors 17*a*, 17*b*, 17*c* are rejoined by rounded transition zones 18*a*, 18*b*, 18*c*.

This embodiment of the lower face of the foot 15 of the container 10 explains the form of the areas of support 16, comprising two stops 19*a*, 19*b* orientated at 120°, joined by a rounded 20.

This foot form allows to avoid drops stagnating in the lower face of the foot 15 when the container 10 is turned upside down, as it is the case for the majority of the existing containers.

In some embodiments, the container 10 comprises at least one handle 23.

In some embodiments, the container 10 does not have a handle 23.

The container 10 according to the invention may be made in porcelain. It may also be made in glass with or without minerals, in crystal, or in another material or mixture of materials, for example, ceramics, and preferably without any heavy metals.

The range of the present invention is not limited to the details of forms of embodiment above considered as examples, but extends, on the contrary, to modification to the scope of the man skilled in the art.

The invention claimed is:

1. A container to taste coffee or tea, comprising one parison, globally with a rotational symmetry around a vertical axis Z, the parison comprising contours and at least one relief on an internal wall of the parison, the relief extending helically from a height of the parison, lower than or equal to a level of a mouth of the parison, to a level higher than or equal to a bottom of the parison; wherein the parison is configured to receive the coffee or tea on one of the contours of the parison and to slide the coffee or tea along a helix formed by the relief, wherein the relief is a shoulder of an internal surface of the parison and further inclines according to an angle a towards a top of an the internal surface of the parison in relation to a plane perpendicular to the vertical axis Z to form a gutter with an internal surface of the parison on at least one part of a length of the helix formed by the relief, and wherein a part of the relief nearest to the vertical rotational axis Z, which is a stop at a top of the relief, is higher than a part of the relief nearest to the internal surface of the parison.

2. The container according to claim 1, wherein the bottom of the parison is egg-shaped.

3. The container according to claim 1, wherein the relief extends helically according to a slope angle ranging from 20° to 45° in relation to a plane perpendicular to the vertical axis Z.

4. The container according to claim 3, wherein the relief extends helically according to a slope angle equal to 35° in relation to the plane perpendicular to the vertical axis Z.

5. The container according to claim 1, further comprising, at a level of at least one of the two ends of the helix formed by the relief, an attenuation of the relief in a form of a wave until the relief disappears.

6. The container according to claim 1, further comprising at least one foot with at least one area of support with a surface.

7. The container according to claim 6, wherein said at least one foot comprises at least three areas of support.

8. The container according to claim 1, further comprising a flared mouth.

* * * * *